US005416461A

United States Patent [19]

Totsuka et al.

[11] Patent Number: 5,416,461

[45] Date of Patent: May 16, 1995

[54] FUSIBLE LINK

[75] Inventors: Mitsuhiko Totsuka; Toshiharu Kudo, both of Shizuoka, Japan

[73] Assignee: Yazaki Corporation, Tokyo, Japan

[21] Appl. No.: 91,985

[22] Filed: Jul. 16, 1993

[30] Foreign Application Priority Data

Jul. 17, 1992 [JP] Japan ..... 4-055951 U

[51] Int. Cl.[6] ..... H01H 85/16

[52] U.S. Cl. ..... 337/261; 337/263

[58] Field of Search ..... 337/295, 255, 260, 261, 337/262, 263, 264

[56] References Cited

U.S. PATENT DOCUMENTS 4,224,592 9/1980 Urani et al. ..... 337/260

4,504,815 3/1985 Harwath ..... 337/201

FOREIGN PATENT DOCUMENTS 6433146 3/1989 Japan .

*Primary Examiner*—Lincoln Donovan

*Attorney, Agent, or Firm*—Sughrue, Mion, Zinn, MacPeak & Seas

[57] ABSTRACT

Disclosed is a fusible link which assures that a fuse element is completely and firmly received in a housing without any occurrence of incorrect contact of a male terminal with an opponent female terminal. Lances slantwise extending from a fuse element received in a housing are engaged with stepped engagement portions. While a cover is fitted to the housing, a plurality of projections extending from the cover are brought in contact with electrical contact portions of the fuse element so that the fuse element is firmly received in the housing at a predetermined position. Consequently, the fuse element is reliably received in the housing in the double engaged state without an occurrence of incorrect insertion of the fuse element.

5 Claims, 2 Drawing Sheets

FUSIBLE LINK

BACKGROUND OF THE INVENTION

1. Field of the invention

The present invention relates generally to a fusible link. More particularly, the present invention relates to a cartridge type fusible link wherein a fuse element composed of a female terminal member is received in a housing of the fusible link.

2. Prior art

For example, as shown in FIG. 5, a conventional cartridge type fusible link is constructed such that an opposing pair of female terminal members 10 each including an electrical contact portion 11 at one end as seen in the longitudinal direction thereof are arranged in a housing 30 and a fuse element 20 including a fusible portion 12 between the other ends of the female terminal members 10 is received in the housing 30 (e.g. Unexamined Japanese Utility Model Application Sho. 64-33146).

With the conventional fusible link constructed in the above-described manner, the housing 30 includes receiving chambers 32 in each of which stepped engagement portion 32*a* is formed to receive a lance 11*a* extending upwardly from the electrical contact portion 11 as illustrated within the range defined by a circle P in the drawing. Thus, undesirable disconnection of the fuse element 20 from the housing 32 can reliably be prevented by bringing the lance 11*a* in engagement with the stepped engagement portion 32*a*.

A cover member (hereinafter referred to simply as a cover) 40 adapted to cover an opening portion 30*a* of the housing 30 therewith is fitted to the housing 30 while the fuse element 20 is received in the housing 30, whereby invasion of dust or similar foreign materials from the outside is prevented by the cover 40 so as to protect the fuse element 20 from the invasion of the dust or the like, and moreover, scattering of small fused pieces away from the housing 30 to the outside at the time of fusion of the fuse element 20 is prevented by the cover 40.

In addition, a proposal has been made as to other type of method of holding a fuse element in a housing in the engaged state wherein disconnection of the fuse element from the housing is prevented by bringing each housing lance formed in the housing in engagement with the corresponding engagement hole formed in an electrical contact portion of the fuse element.

Each of the conventional fusible links constructed in that way is employed for a circuit through which a comparatively high intensity of electric current is required to flow. Since connected locations on the fuse element have small contact resistance, the fuse element is reliably secured to the housing, and the fuse element can easily be replaced with a new one after an occurrence of fusion, many conventional fusible links of the foregoing type are put in practical use.

With respect to the conventional fusible links constructed in the above-described manner, however, since the engagement of the fuse element with the housing is achieved merely by primary engagement of the lances with the stepped engagement portions, there arises a malfunction that both male and female terminals come in incorrect contact with each other due to unsatisfactory connection therebetween. Specifically, in case of a fusible link of the type wherein male and female terminals are connected to each other by inserting the male terminal from the outside into the opponent female terminal received in the housing, since the male terminal is squeezed against the clamp force of the female terminal at the time of fitting of the male terminal into the opponent female terminal, there arises an occasion that if the fuse element is insufficiently retained in the housing, as the male terminal is squeezed in the housing, the fuse element may be dislocated by the action of the clamping force of the female terminal in the rearward direction, resulting in the male terminal failing to be firmly engaged with the female terminal.

In view of the forgoing problem, an object of the present invention is to provide a fusible link which assures that incorrect insertion of a fuse element can reliably be prevented, and moreover, the fuse element can immovably be held in the double engaged state without any possibility that both male and female terminals are incompletely connected to each other.

To accomplish the above object, the present invention provides a fusible link including a housing molded of an electrical insulative material and having an opening portion formed thereon, a fuse element adapted to be inserted into the housing through the opening portion so as to be firmly engaged with the housing, and a cover member fitted to the housing while covering the opening portion of the housing therewith, wherein a plurality of projections for preventing the fuse element from being incorrectly inserted into the housing by bringing the foremost ends of the projections in contact with the fuse element are projected from the inner surface of the cover member.

When the projections extending from the inner surface of the cover member are inserted into the housing while the foremost ends of the projections are brought in contact with the fuse element, lances slantwise extending from the fuse element are engaged with stepped engagement portions on the housing so as enable the fuse element to be firmly held in the housing. Since the foremost ends of the projections come in contact with the fuse element when the cover member is fitted to the housing, the fuse element can reliably be held in the housing at a predetermined position without any possibility of dislocation of the fuse element from the predetermined position. Consequently, the fuse element is immovably held in the housing in the double engaged state by the engagement of the lances with the stepped engagement portions on the housing as well as the engagement derived from the continuous contact of the foremost ends of the projections with the fuse element attained by the fitting of the cover member to the housing.

DETAILED DESCRIPTION OF THE PREFERRED EMBODIMENTS

The present invention will now be described in detail hereinafter with reference to the accompanying drawings which illustrate a few preferred embodiments thereof.

Figure 1:
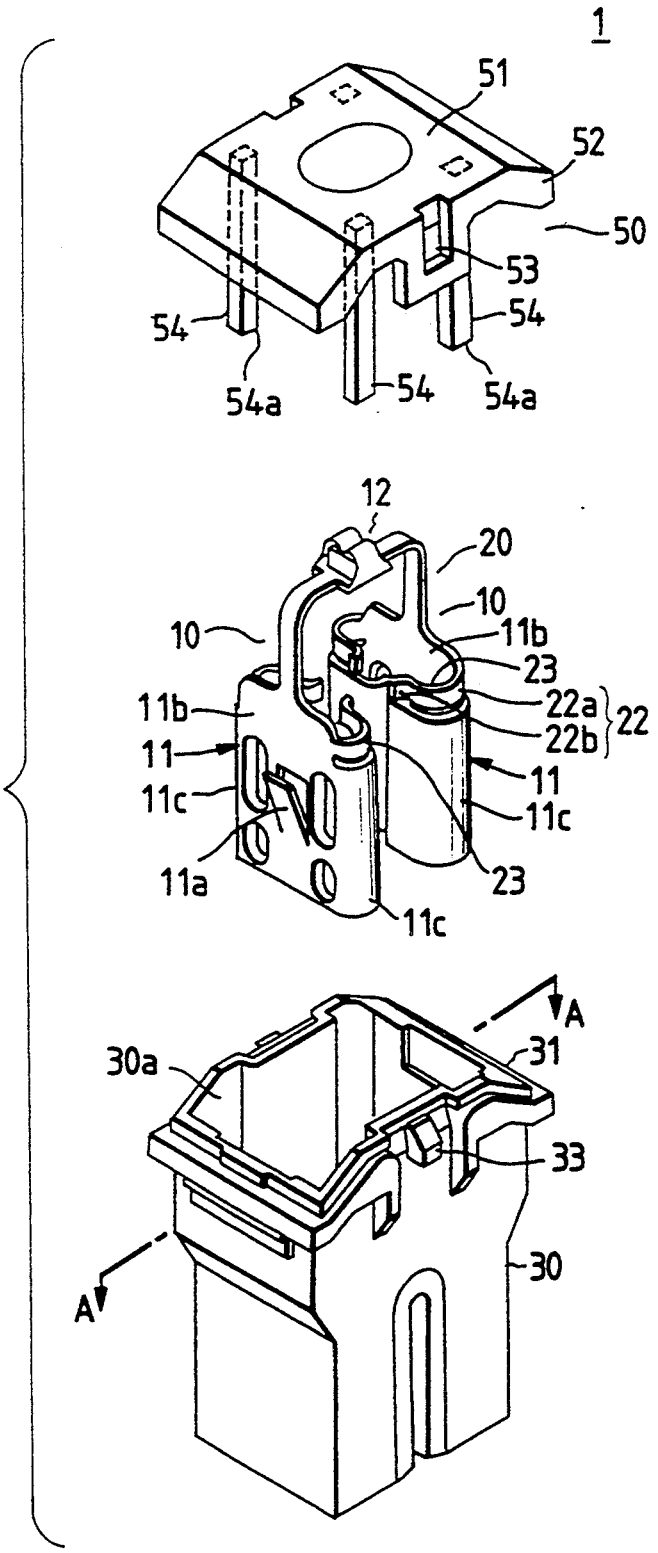
FIG. 1 is a perspective view of a fusible link constructed according to an embodiment of the present invention, particularly showing essential components constituting the fusible link in the disassembled state.

FIG. 1 is a perspective view of a fusible link constructed according to an embodiment of the present invention, particularly showing essential components constituting the fusible element in the disassembled state.

Figure 5:
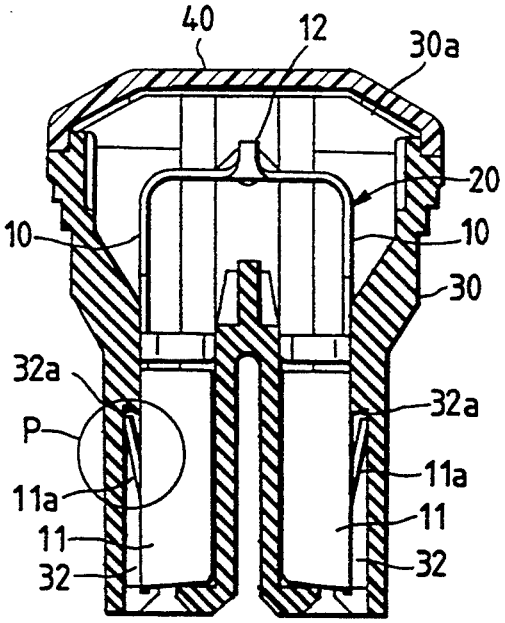
FIG. 5 PRIOR ART
FIG. 5 is a sectional view of a typical conventional fusible link.

In this embodiment, the fusible link generally designated by reference numeral 1 is constructed such that a cover member similar to the cover 40 described above with reference to FIG. 5 additionally includes a plurality of projections in order to assure that incomplete insertion of a fuse element into a housing is reliably prevented, and moreover, the fusible link 1 is reliably held in the housing in the double engaged state. Incidentally, for the same of convenience, same components .as those shown in FIG. 5 are represented by same reference numerals with the exception of the cover member and associated components.

Specifically, as shown in FIG. 1, the fusible link 1 is composed of a housing 30 molded of an electrically insulative material in the box-shaped configuration including an opening portion 30*a*, a fuse element 20 to be received in the housing 30, and a cover member (hereinafter referred to simply as a cover) 50 molded of a transparent synthetic resin to be fitted into the opening portion 30*a* of the housing 30.

When the cover 50 is fitted to the housing 30, a peripheral wall portion 52 defining a rectangular cover portion 51 corresponding the opening portion 30*a* of the housing 30 is brought in close contact with an outer peripheral edge 31 of the housing 30. To firmly secure the cover 50 to the housing 30, engagement projections 33 projecting outside of the outer peripheral edge 31 of the housing 30 are engaged with engagement recesses 53 formed on the opposite long sides of the peripheral wall portion 52 of the cover 50. In addition, four rod-shaped projections 54 are projected outside of the inner. wall surface of the rectangular cover portion 51.

The projections 54 are arranged in the vicinity of four corners of the cover portion 51 at the positions corresponding to the geometrical configuration of the fuse element 20 as will be described later. The projections 54 are dimensioned to have a sufficiently long length to positionally restrictively hold the fuse element 20 in the housing 30 at a predetermined position with the foremost end parts thereof when the cover 50 is fitted to the housing 30.

The cover 50 is molded of a transparent synthetic resin in the same manner as the conventional cover 40 described above with reference to FIG. 5 so as to enable an operator to visually confirm from the outside whether the fuse element 30 is molten or not.

The fuse element 20 is designed in the inverted U-shaped configuration in such a manner that an opposing pair of female terminal members 10 include electrical contact portions 11 and the upper end parts of the female terminal members 10 are curvedly bent to joint to each other at a fusible portion 12 located at the summit of the inverted U-shaped configuration.

Each of the electrical contact portions 11 is made of a metallic material having a low melting temperature, and the opposite sides of an opposing pair of base plates 11*b* of the electrical contact portions 11 are semicircularly bent to form elastic clamping pieces 11*c*. When terminal portions of a tab type male terminal (not shown) are inserted into the clamping pieces 11*c*, they are brought in close contact with the base plates 11*b* of the electrical contact portions 11. In addition, a lance 11*a* is formed integral with each base plate 11*b* by slantwise upward extending from the same. Two pairs of semicircular portions 22*a* are formed on the opposite sides of the base plates 11*b* at the positions located opposite to partition walls 34 of the housing 30, and moreover, two pairs of elastic thrusting pieces 22 bent at a substantially right angle relative to inner ends 22*b* of the semicircular portions 22*a* are formed at the upper ends of the electrical contact portions 11 while projecting in the opposite direction relative to each other.

The housing 30 will be described below in more detail with reference to FIG. 1 and FIG. 2.

Specifically, the housing 30 is molded of a heat-resisting synthetic resin by employing an injection molding process, and a parallelpiped-shaped space 35 having the opening portion 30*a* formed at the upper end thereof is formed in an upper half of the housing 30 having a depth substantially equal to a half of the height of the housing 30. A lower half of the housing 30 is divided into two chambers with the partition walls 34 interposed therebetween to serve as receiving chambers 32 for receiving the electrical contact portions 11 therein. Stepped engagement portions 32*a* adapted to engageably receive the lances 11*a* of the fuse element 20 therein are formed on the inner walls of the receiving chambers 32 located opposite to the base plates 11*b* of the electrical contact portions 11 in order to prevent the fuse element 20 from being disconnected from the housing 30. In addition, holes 32*c* through which the terminal portions of the opponent male terminal are inserted are formed through bottom wall is 32*b* of the receiving chambers 32 each adapted to serve as a stopper when the fuse element 20 is received in the housing 30. Engagement projections 33 adapted to be engageably fitted into the engagement recesses 50 on the cover 50 are projected from the outer peripheral surface of the opening portion 30*a* of the housing 30.

Next, the fusible link 1 assembled with the aforementioned components according to the foregoing embodiment of the present invention will be described below.

Figure 2:
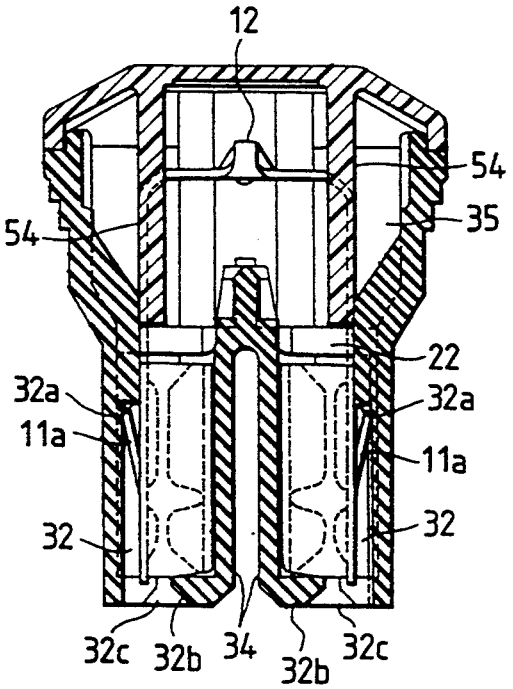
FIG. 2 is a sectional view of the fusible element taken along line A—A in FIG. 1.

FIG. 2 is a sectional view of the fusible link 1 taken along line A—A in FIG. 1, particularly showing the operative state that the fuse element 20 is received in the housing 30.

The receipt of the fuse element 20 in the housing 30 is achieved by forcibly inserting the projections 54 of the cover 50 into the housing 30 until foremost ends 54*a* of the projections 54 come in contact with upper end edges 23 of the electrical contact portions 11 each serving as a shoulder of the elastic thrusting piece 22. Subsequently, when the engagement projections 33 on the housing 30 are engaged with the engagement recesses 53 on the cover portion 51 so that the cover 50 is fixedly secured to the housing 30, the projections 54 serve to allow the lowermost ends of the electrical contact portions 11 to collide against the bottom walls 32*b* of the receiving chambers 32, whereby the electrical contact portions 11 are immovably arranged at their predetermined positions without any possibility that the fuse element 20 is incorrectly inserted into the housing 30.

While the electrical contact portions 11 are arranged at the predetermined positions in that way, the foremost ends 54*a* of the projections 54 are brought in contact with the elastic thrusting pieces 22. At this time, the inner ends 22*b* of the elastic thrusting pieces 22 are brought in close contact with the partition walls 34 in the housing 30, and moreover, the base plates 11*b* of the electrical contact portions 11 are likewise brought in close contact with the inner wall of the housing 30 by the resilient force of the electrical contact portions 11, causing the lances 11*a* to be engaged with stepped engagement portions 32*a*. Consequently, since the electrical contact portions 11*a* of the fuse element 20 are immovably received in the receiving chambers 32 without any play in the double engaged state attainable by the engagement of the lances 11*a* with the stepped engagement portions 32*a* as well as the engagement derived from the continuous contact of the projections 54 with the fuse element 20 attained when the cover 50 is firmly secured to the housing 50, there does not arise a malfunction that the fuse element 20 is loosely dislocated in the housing 30 due to the vibrative force imparted to the fuse element 20 from the outside. Moreover, an intensity of the retaining force of the fusible link 1 for preventing the fuse element 20 from being disconnected from the housing 30 is substantially increased.

When the fusible link 1 constructed in the above-described manner is fitted into a fuse box (not shown), terminal portions of a tab type male terminal projecting outside from the fuse box are inserted into the receiving chambers 32 through the holes 32*c* of the bottom walls 32*b*. At this time, since incorrect insertion of the fuse element 20 into the housing 30 is reliably prevented by the projections 54 and an intensity of the retaining force for preventing the fuse element 20 from being disconnected from the housing 30 is substantially increased, the terminal portions of the tab type male terminal can always reliably be inserted into the electrical contact portions 11 of the fuse element 20 at the predetermined positions without any incorrect contact between both the male and female terminals.

While the present invention has been described above with respect to the embodiment wherein the female terminal members 10 are received in the housing 30 and terminal members of a male terminal are inserted into the female terminal members 10 from the outside, it should of course be understood that the present invention should not be limited only to this embodiment but it may equally be applied to another type of fusible link wherein connection plates constituting a fuse element are projected outside of a housing so that they are threadably connected to an outer terminal using bolts and nuts. In practice, however, this type of fusible link has a problem that when the fusible link is connected to the outer terminal, a force effective for disengaging the fuse element from the housing is hardly generated. For this reason, the advantageous effect attainable from the fusible link constructed according to the present invention is degraded.

Further, the present invention has been described above with respect to the embodiment wherein the fusible link is constructed such that the lances slantwise extending from the fuse element are engaged with the stepped engagement portions. Alternatively, the foregoing lances may be combined with housing lances formed on the housing side while projecting therefrom to be engaged with engagement holes formed on the fuse element side.

Figure 3:
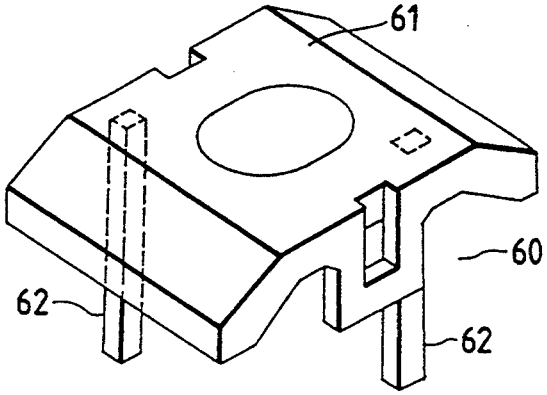
FIG. 3 is a perspective view of a cover constructed according to other embodiment of the present invention to be employed for the fusible link.

FIG. 3 shows by way of perspective view a cover constructed according to other embodiment of the present invention to be employed for a fusible link. As is apparent from the drawing, this embodiment is different from the preceding embodiment described above with reference to FIG. 1 in respect of the number of projections extending from the cover.

Specifically, the cover designated by reference numeral 60 includes two rod-shaped projections 62 which are diagonally arranged while projecting outside of the inner wall surface of a rectangular cover portion 61 of the cover 60 in the same manner as the preceding embodiment shown in FIG. 1. With the cover 60 constructed in the above-described manner, when the projections 62 are inserted into the housing 30 to come in contact with a fuse element 20, the fuse element 20 can immovably be held in the housing 30 with the aid of the projections 62 each having a predetermined length. In other words, the fuse element 20 can be located at a predetermined position in the housing 30 while the positions of the projections 62 are restrictively determined in the housing 30.

Figure 4:
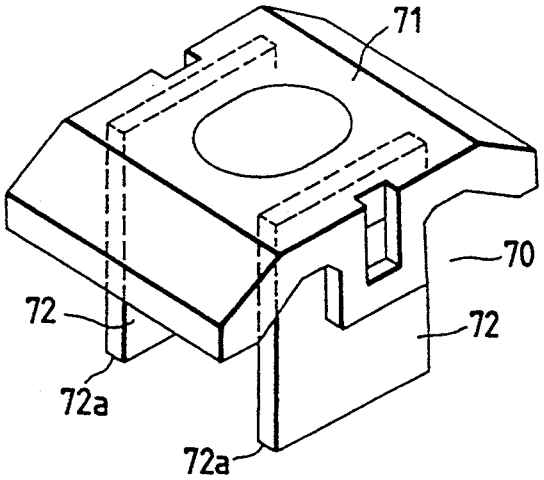
FIG. 4 is a perspective view of a cover constructed according to another embodiment of the present invention.

Similarly, FIG. 4 shows by way of perspective a cover constructed according to another embodiment of the present invention to be employed for a fusible link.

In this embodiment, the cover designated by reference numeral 70 includes two plate-shaped projections 72 which are projected outside of the inner wall surface of a rectangular cover portion 71 of the cover 70 while extending in parallel with each other until the foremost ends 72 of the projections 72 come in contact with an opposing pair of electrical contact portions 11 of the fuse element 20 as shown in FIG. 2 as if each projection 72 is bridged between the upper end edges 23 of the elastic thrusting pieces 23.

With this construction, the projections 72 can reliably be brought in contact with the upper end edges 23 of the elastic thrusting pieces 22 regardless of any slight positional offset of the foremost ends 72*a* of the projections 72 from the upper end edges 23 of the elastic thrusting pieces 22 attributable to possible machining error of these components.

As is apparent from the above description, according to the present invention, since the fuse element is firmly received in the housing of the fusible link with an increased intensity of retaining force effective for preventing the fuse element from being disconnected from the housing, there does not arise a malfunction that male and female terminals incorrectly come in contact with each other due to undesirable deformation of, e.g., terminal lances slantwise extending from the electrical contact portions as is often the case with the conventional fusible link. In contrast with the conventional fusible link wherein the fuse element is received in the housing merely with the primary engagement attained by the engagement of the lances with the corresponding stepped engagement portions on the housing while an intensity of retaining force is reduced due to undesirable deformation of the lances, according to the present invention, since the fuse element is firmly received in the housing without any occurrence of incorrect insertion of the fuse element not only with the aid of a plurality of projections extending from the cover fitted to the housing but also by the double engaged state attainable by the engagement of the lances with the stepped engagement portions on the housing as well as the engagement of the engagement projections on the housing with the engagement recesses on the cover, there do not appear the problems inherent to the conventional fusible link. In addition, according to the present invention, since there is no need of modifying the components constituting the fusible link with the exception of the cover, and moreover, there is no need of additionally arranging new components for the fusible link, the fusible link can be produced without any increase of a production cost so as to enable the fuse element to be reliably received with the housing in the double engaged state without an occurrence of incorrect connection between both male and female terminals attributable to incorrect contact therebetween. It should be added that the original properties of the cover for the fusible link are not degraded at all.

What is claimed is:

1. A fusible link comprising:

a housing molded of an electrical insulating material and having an opening formed thereon;

a fuse element insertable into said housing through said opening;

first locking means for primarily locking said fuse element in a predetermined position within said housing;

a cover member fitted to said housing for covering said opening of said housing therewith;

second locking means for secondarily locking said fuse element in said predetermined position, said second locking means being integral to said cover member; and insertion means for facilitating insertion of said fuse element to said predetermined position in said housing wherein said second locking means includes said insertion means and wherein said insertion means is integral to said cover member and directly contacts said fuse element so as to positively urge said fuse element to said predetermined position when said cover member is secured to said housing.

2. A fusible link as claimed in claim 1, wherein said secondary locking means includes:

a plurality of projections for bringing the foremost ends of said projections into contact with said fuse element.

3. A fusible link as claimed in claim 2, wherein said projections are rod-shaped.

4. A fusible link as claimed in claim 2, wherein said projections are plate-shaped.

5. A fusible link comprising:

a housing molded of an electrical insulating material and having an opening formed thereon;

a fuse element insertable into said housing through said opening;

first locking means for primarily locking said first element in a predetermined position within said housing;

a cover member fitted to said housing while covering said opening of said housing therewith; and insertion means for facilitating insertion of said fuse element to said predetermined position, said insertion means being integral to said cover and directly contacting said fuse element, wherein said insertion means positively urges said fuse element to said predetermined position when said cover member is secured to said housing.

* * * * *